United States Patent [19]

Brenner et al.

[11] Patent Number: 4,777,689

[45] Date of Patent: Oct. 18, 1988

[54] APPARATUS FOR THE DECORING OF CASTINGS

[75] Inventors: Peter Brenner; Dieter Dettwiler; Horst Kreikenbaum, all of Schaffhausen, Switzerland

[73] Assignee: Georg Fischer Aktiengesellschaft, Schaffhausen, Switzerland

[21] Appl. No.: 848,824

[22] Filed: Apr. 4, 1986

[30] Foreign Application Priority Data

Apr. 9, 1985 [CH] Switzerland ..... 1506/85

[51] Int. Cl.[4] ..... B22D 29/02

[52] U.S. Cl. ..... 15/94; 164/404

[58] Field of Search ..... 15/91, 94; 29/81 R, 29/DIG. 7, DIG. 46; 164/344, 345, 404

[56] References Cited

U.S. PATENT DOCUMENTS

| | | | |
|---|---|---|---|
| 1,570,716 | 1/1926 | Stoney | 15/94 |
| 1,768,428 | 6/1930 | Stoney | 15/94 |
| 2,160,581 | 5/1939 | Behnke | 15/94 |

FOREIGN PATENT DOCUMENTS

| | | | |
|---|---|---|---|
| 3219390 | 12/1982 | Fed. Rep. of Germany . | |
| 3239262 | 4/1984 | Fed. Rep. of Germany . | |
| 3341894 | 3/1985 | Fed. Rep. of Germany . | |
| 0097863 | 7/1980 | Japan | 164/404 |
| 58-148073 | 9/1983 | Japan . | |
| 0027767 | 2/1984 | Japan | 164/404 |
| 2063739 | 6/1981 | United Kingdom . | |
| 2067938 | 8/1981 | United Kingdom . | |

*Primary Examiner*—Edward L. Roberts

*Attorney, Agent, or Firm*—Toren, McGeady & Associates

[57] ABSTRACT

An impact device and a turning device are arranged with a sound-insulating cabin and are operatively connected with one another through roller conveyors and lifting tables. Castings conveyed into the decoring station by means of conveyor pallets are clamped in a clamping frame. An impact device for decoring the casting imparts percussions on the clamping frame. Subsequently, the loosened core sand is removed from the casting in a turning device.

9 Claims, 3 Drawing Sheets

APPARATUS FOR THE DECORING OF CASTINGS

BACKGROUND OF THE INVENTION

1. Field of the Invention

The present invention relates to an apparatus for the decoring of castings, such as cylinder blocks, by means of at least one impact device.

2. Description of the Prior Art

Apparatus of the type described above are known from German Auslegeschrift No. 29 47 795 and U.S. Pat. No. 1,768,428. The prior art apparatus have the disadvantage that the impact device or hammer acts directly on the casting to be decored. This may cause damage to the castings and thus may make the castings useless, particularly in the case of castings having thin walls and a large number of cores, such as cylinder blocks for engines or similar workpieces of gray cast iron. Due to the increased use of castings of lightweight construction, the known apparatus can be used only to a limited extent and their use is usually limited to simple castings having a small number of cores of aluminum.

It is, therefore, the primary object of the invention to provide an apparatus for the decoring of castings which have thin walls and complicated cores without causing damage to the castings. In addition, it is an object of the invention to provide an apparatus which makes possible an automatic operation without subsequent manual operating steps.

SUMMARY OF THE INVENTION

In accordance with the present invention, the apparatus for the decoring of castings by means of at least one impact device include a clamping or support frame which holds the casting to be decored in position, wherein the impact device is constructed so as to act on the clamping frame.

Since the percussions generated by the impact device act indirectly on the castings on a clamping frame, the local impact load on the casting is substantially reduced, so that the casting is not damged although an effective percussion action can occur.

An advantageous rigid clamping of the casting in the clamping frame can be effected by a hydraulic clamping means.

In accordance with a further development of the invention, the casting can be conveyed into the clamping frame on a conveyor pallet and the conveyor pallet clamped to the clamping frame is subjected to the percussion action of the impace device.

In accordance with another advantageous embodiment of the invention, the apparatus for the decoring of castings includes a turning device in which the hollow spaces of the castings are emptied from the core sand which has been previously loosened by the percussion effect of the impact device. In addition, the apparatus may include roller conveyors and lifting tables at each end of the roller conveyors, so that an automatic operation is made possible and the empty conveyor pallets can be returned, while the overall apparatus requires little space.

In accordance with another advantageous feature of the invention, the decoring device and the turning device are arranged in a sound-insulating cabin in order to contain the noise and dust generated by the decoring apparatus.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described a preferred embodiment of the invention.

DETAILED DESCRIPTION OF THE INVENTION

Figure 1:
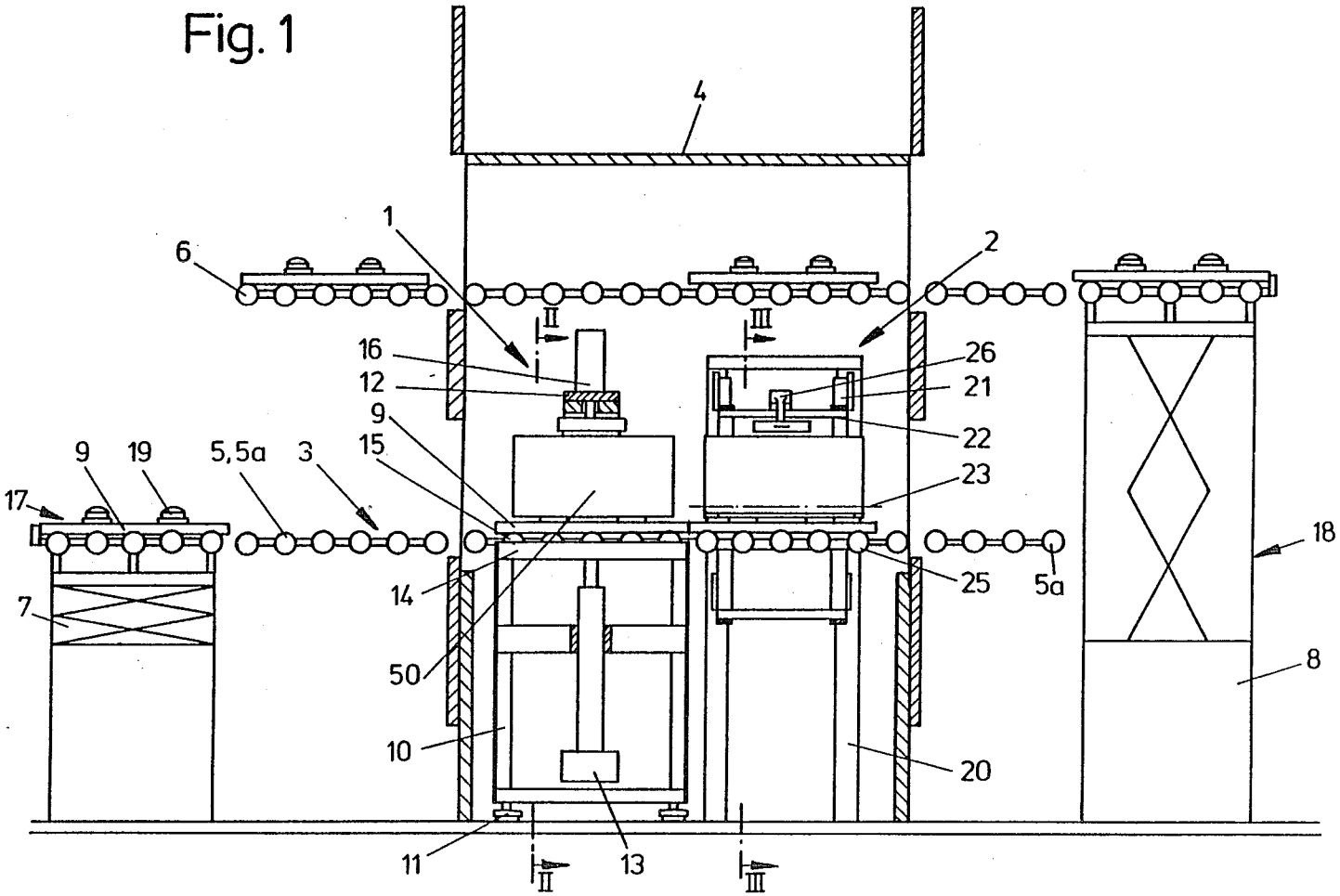
FIG. 1 is a front elevational view of the apparatus according to the invention.

As illustrated in FIG. 1 of the drawing, the apparatus according to the invention has a decoring device 1, a turning device 2 and a conveyor device 3. The decoring device 1 and the turning device 2 are arranged in a sound-insulating cabin 4. Two roller conveyors 5 and 6 for conveyor pallets 9 extend through cabin 4. The roller conveyors 5 and 6 are operatively connected at their ends on both sides of cabin 4 by means of two lifting tables 7 and 8.

Figure 2:
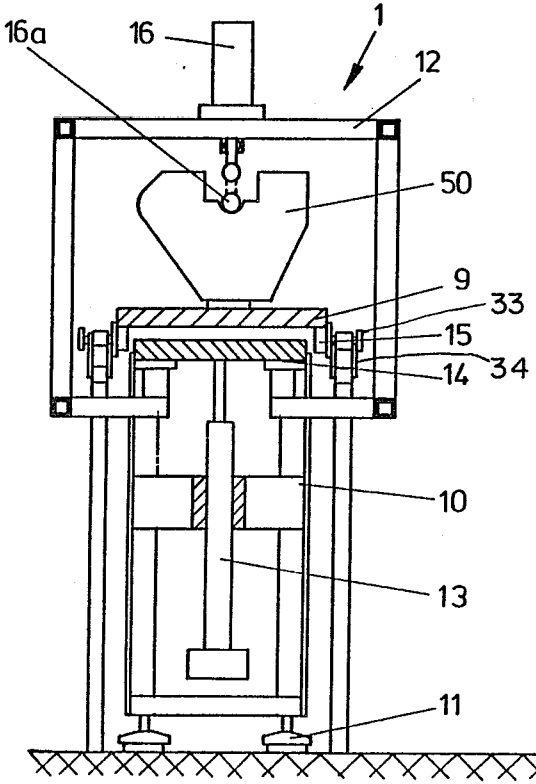
FIG. 2 is a sectional view, on an enlarged scale, of the apparatus of FIG. 1 along sectional line II—II.
Figure 4:
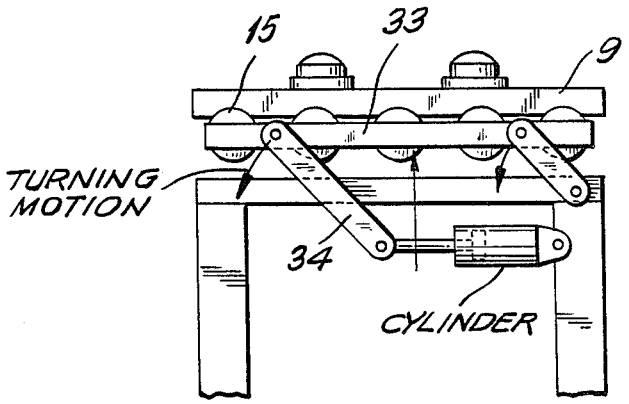

As shown in FIGS. 1 and 2, the decoring device 1 has a stand 10 mounted on vibration dampers 11. A clamping frame 12 is vertically movably mounted on stand 10. At least one, preferably pneumatically operated impact device 13 acts from below on a transverse member 14 of clamping frame 12. Conveyor rollers 15 are mounted on stand 10 in such a way that they can be raised and lowered. In their uppermost position, rollers 15 extend in a plane with rollers **5*a* and form part of roller conveyor 5. The conveyor rollers 15 are attached to bearing members 33 which, in turn, are attached to turnable connecting bars 34. By turning the connecting bars 34, the bearing members 33 and, thus, the conveyor rollers 15 can be raised and lowered. By lowering the conveyor rollers 15, the conveyor pallets 9 carrying the casting 50 to be decored are lowered onto transverse member 14 of frame 12. A clamping means 16, preferably a hydraulic cylinder, is mounted on the clamping frame 12 of the side opposite the impact device 13 and presses upon actuation a clamping element 16*a* against casting 50, so that the latter together with conveyor pallet 9 resting on transverse member 14 are rigidly clamped in clamping frame 12. Percussion generated in rapid sequence by impact device 13 reach casting 50 indirectly through clamping frame 12 and conveyor pallet 9, so that the core or the rigid core sand in casting 50** is loosened.

Figure 3:
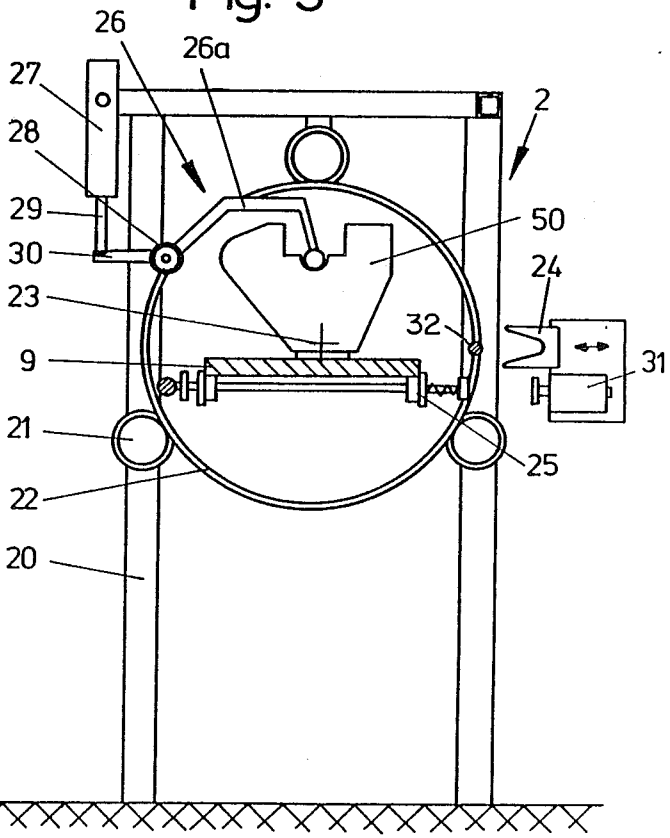
FIG. 3 is a sectional view, on an enlarged scale of the apparatus of FIG. 1 along line III—III.

A turning station illustrated in FIGS. 1 and 3 includes a stand 20 which has rollers 21 distributed on its circumference. A frame 22 is mounted between rollers 21 so as to be rotatable about a horizontal axis 23. Frame 22 has conveyor rollers 25 which form part of roller conveyor 5 when in a horizontal position determined by a locking device 24. For locking frame 22 in this position, locking device 24 is movable into engagement with member 32 forming part of frame 22, as indicated by the double arrow in FIG. 3. In this position, conveyor rollers 25 are operatively connected to a drive 31 by means of clutch disks shown in FIG. 3. A clamping device 26 is mounted of frame, 22. Clamping device 26 has a clamping arm **26*a* which is pressed by means of a spring force against casting 50. When the conveyor pallet 9 with casting 50 is to be conveyed in or out of the turning station, clamping arm 26***a* can be raised against the force of the spring from casting 50 by means of an actuating device 27 mounted on stand 20. The spring force is preferably generated by a torsion spring 28. The actuating device 27 is preferably a pneumatically or hydraulically operated cylinder whose piston rod 29 can be pressed against a lever 30 of clamping arms 26*a* and is moved into an entirely retracted position during the rotation of frame 22. By means of a motor-driven roller 21 or another drive mechanism, the casting 50 clamped into frame 22 is turned until the hollow spaces of the casting are free of already loosened core sand.

Conveyor device 3 ensures an automatic operation of the apparatus according to the invention. The first lifting table 7 also serves as the loading station 17 for conveyor pallets 9. The castings 50 supplied, for example, from an emptying station, are placed onto conveyor pallets 9 by means of a device which is not illustrated in detail and the castings 50 are held on the conveyor pallets 9 in a fixed position by means of parts 19 engaging the castings 50. In the apparatus as illustrated, castings 50 are cylinder blocks of engines, wherein the parts 19 are constructed as pins and engage in the cylinder bores. Depending upon the size of the cylinder blocks to be decored, pins 19 can also be inserted into the conveyor pallets 9 with different predetermined spacing.

On lower roller conveyor 5, the conveyor pallets 9 carrying castings 50 are conveyed into the decoring device 1 through a closable cabin opening. As already described, the cores of castings 50 are destroyed or loosened by percussions of impact device 13 which act indirectly on the castings.

After loosening the clamping means 16 and raising the conveyor rollers 15, the conveyor pallet 9 carrying casting 50 is rolled into the turning device 2. As already described, the hollow spaces of the casting are emptied by rotating it in the turning device 2. Subsequently, the completely decored casting 50 is conveyed on conveyor pallet 9 by means of rollers 5*a* to an unloading station 18 which is constructed as a lifting table 8. In a manner not illustrated in detail, casting 50 is lifted from conveyor pallet 9 on a lifting table 8 and is conveyed to another conveying device. Lifting table 8 raises the empty conveyor pallet until it reaches the level of the upper roller conveyor 6 and is subsequently conveyed through cabin 4 to the first lifting table 7 Within cabin 4, the conveyor pallets are cleaned, for example, by means of compressed air and/or brushes. The conveyor pallet rolled onto lifting table 7 is then lowered to the level of the lower roller conveyor 5, where another casting can be placed on the conveyor pallet.

The entire operation is carried out automatically in cycles in such a way that conveyor pallets 9 with castings 50 are placed at the same time in decoring device 1 and in turning device 2 and that at least four additional conveyor pallets 9 are simultaneously in operation, as illustrated in FIG. 1.

While the specific embodiment of the invention has been shown and described in detail to illustrate the application of the inventive principles, it will be understood that the invention may be embodied otherwise without departing from such principles.

We claim:

1. An apparatus for the decoring of castings, comprising a clamping frame for holding the casting, and at least one impact device for imparting percussions on the clamping frame holding a casting, the clamping frame including at least one clamping means mounted on the side of the clamping frame opposite the impact device, wherein the casting is placed on a conveyor pallet in a fixed position and the casting is moved into the clamping frame on the conveyor pallet, and wherein the clamping frame comprises a transverse support member, the conveyor pallet being lowered onto the transverse support member and clamped together with the transverse support member.

2. The apparatus according to claim 1, wherein the clamping means is a hydraulic cylinder.

3. The apparatus according to claim 1, comprising a stationary stand for vertically movably guiding the clamping frame, wherein the impact device acts from below on the transverse support member of the clamping frame.

4. The apparatus according to claim 5, wherein the stand 10 includes conveyor rollers for conveying the conveyor pallets.

5. The apparatus according to claim 3, comprising outer rollers mounted to form a lower roller conveyor with the raised conveyor rollers in the impact device stand and the further conveyor rollers in the turning device, a loading station mounted at the first end of the lower roller conveyor and an unloading station mounted at the second end of the lower roller conveyor,

6. The apparatus according to claim 3, comprising a turning device for removing the core loosened by the impact device, wherein the conveyor pallet with the casting is movable from the impact device into the turning device.

7. The apparatus according to claim 6, wherein the turning device comprises a rotating frame which rotates about a horizontal axis, the rotating frame including further conveyor rollers for the conveyor pallet and a clamping device for clamping the casting on the pallet in the turning device.

8. The apparatus according to claim 7, wherein the clamping device is a spring-biased clamping arm which is lifted from the casting by means of a stationary actuating device when the casting is moved in or out of the turning device. an upper roller conveyor mounted above the impact device and the turning device and parallel to the lower roller conveyor, the loading and unloading stations including lifting tables for operatively connecting the lower and upper roller conveyors.

9. The apparatus according to claim 6, comprising a sound-insulating cabin which houses the impact device and the turning device.

* * * * *